US007946961B2

(12) United States Patent
Blum et al.

(10) Patent No.: US 7,946,961 B2
(45) Date of Patent: May 24, 2011

(54) EXERCISE APPARATUS AND METHODS

(75) Inventors: Scott Alan Blum, Jackson, WY (US); Kimberly Jane Whitman, Jackson, WY (US)

(73) Assignee: Yoga Today LLC, Jackson, WY (US)

( * ) Notice: Subject to any disclaimer, the term of this patent is extended or adjusted under 35 U.S.C. 154(b) by 72 days.

(21) Appl. No.: 12/336,259

(22) Filed: Dec. 16, 2008

(65) Prior Publication Data

US 2009/0291805 A1 Nov. 26, 2009

Related U.S. Application Data

(60) Provisional application No. 61/055,816, filed on May 23, 2008.

(51) Int. Cl.
*A63B 71/00* (2006.01)

(52) U.S. Cl. ..... 482/8; 482/1; 482/9; 482/901

(58) Field of Classification Search ..... 482/1–9, 482/900–902; 434/247
See application file for complete search history.

(56) References Cited

U.S. PATENT DOCUMENTS

| | | | | |
|---|---|---|---|---|
| 6,027,428 | A * | 2/2000 | Thomas et al. | 482/4 |
| 6,685,480 | B2 * | 2/2004 | Nishimoto et al. | 434/247 |
| 7,635,324 | B2 * | 12/2009 | Balis | 482/142 |
| 2007/0032345 | A1 * | 2/2007 | Padmanabhan et al. | 482/8 |
| 2007/0287597 | A1 * | 12/2007 | Cameron | 482/8 |
| 2008/0090703 | A1 * | 4/2008 | Rosenberg | 482/8 |
| 2008/0194385 | A1 * | 8/2008 | Heung | 482/1 |
| 2008/0207401 | A1 * | 8/2008 | Harding et al. | 482/4 |

* cited by examiner

*Primary Examiner* — Glenn Richman
(74) *Attorney, Agent, or Firm* — Klein, O'Neill & Singh, LLP

(57) ABSTRACT

An exercise apparatus including a video display. In certain embodiments the apparatus includes an integrated platform. Memory within the apparatus contains a library of instructional exercise programs, such as yoga, Pilates, body toning and stretching routines. The apparatus may also connect to a network, such as the Internet to stream and/or download additional exercise programs. A user interface enables the user to select from available programs, which are shown on the video display. Audio for the programs may be provided via speakers or though headphones, which may be rechargeable and/or wireless.

21 Claims, 14 Drawing Sheets

EXERCISE APPARATUS AND METHODS

CROSS-REFERENCE TO RELATED APPLICATION

This application claims priority to provisional application Ser. No. 61/055,816 filed on May 23, 2008, the entire contents of which are hereby incorporated by reference.

BACKGROUND

1. Technical Field

The present invention relates to exercise apparatus.

2. Description of Related Art

Live yoga, Pilates and body toning classes at gyms and yoga studios have limitations. They're often crowded, only offered at scheduled times of the day, and may not match the skill level or physical needs of the practitioner. The only way to be sure a live class meets the particular needs of an attendee is through private instruction, which may cost more than $100 per hour.

SUMMARY

The various embodiments of the present exercise apparatus have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide advantages, which include private and personalized yoga, Pilates and body toning instruction at a fraction of the cost of private lessons.

One aspect of the present exercise apparatus includes the realization that large group classes have many drawbacks. At the same time, private, one-o-one instruction is very expensive. Accordingly it would be of great benefit to practitioners to have available a system that could provide private and personalized instruction at a fraction of the cost of private lessons.

One embodiment of the present exercise apparatus comprises a platform configured to support a user while exercising. The exercise apparatus further comprises a mass storage module including a plurality of instructional exercise programs. A user interface enables the user to select one of the exercise programs for playback. A video display shows visual images corresponding to the first exercise program as the program is played back.

One embodiment of the present method of exercising comprises mounting a platform of an exercise apparatus. The method further comprises entering with the aid of a video display and a user interface, user-defined criteria for assisting a user in selecting an exercise program. The user-defined criteria include at least one of program duration, program skill level, program focus, program setting, and instructor. The method further comprises browsing a plurality of exercise programs that meet the user-defined criteria. The method further comprises selecting one of the exercise programs and playing back the selected exercise program. The method further comprises exercising by following instructions provided by the selected exercise program through visual images displayed on the video display and corresponding audio instructions delivered via audio speakers.

Another embodiment of the present exercise apparatus and methods comprises a computer program product. The computer program product comprises a computer usable storage medium having computer readable code embodied therein for assisting a user in exercising using an exercise apparatus. The computer readable code includes code for assisting a user in selecting an exercise program. The code enables the user, with the aid of a video display and a user interface, to enter user-defined criteria into the exercise apparatus. The user-defined criteria include at least one of program duration, program skill level, program focus, program setting, and instructor. The computer readable code further includes code for enabling the user to browse a plurality of exercise programs that meet the user-defined criteria. The computer readable code further includes code for enabling the user to select one of the exercise programs and play back the selected exercise program. The computer readable code further includes code for enabling the user to exercise by following instructions provided by the selected exercise program through visual images displayed on the video display and audio instructions provided via audio speakers.

BRIEF DESCRIPTION OF THE DRAWINGS

The preferred embodiments of the present exercise apparatus now will be discussed in detail with an emphasis on highlighting the advantageous features. These embodiments depict the novel and non-obvious exercise apparatus shown in the accompanying drawings, which are for illustrative purposes only. These drawings include the following figures, in which like numerals indicate like parts.

DETAILED DESCRIPTION

Figure 1:
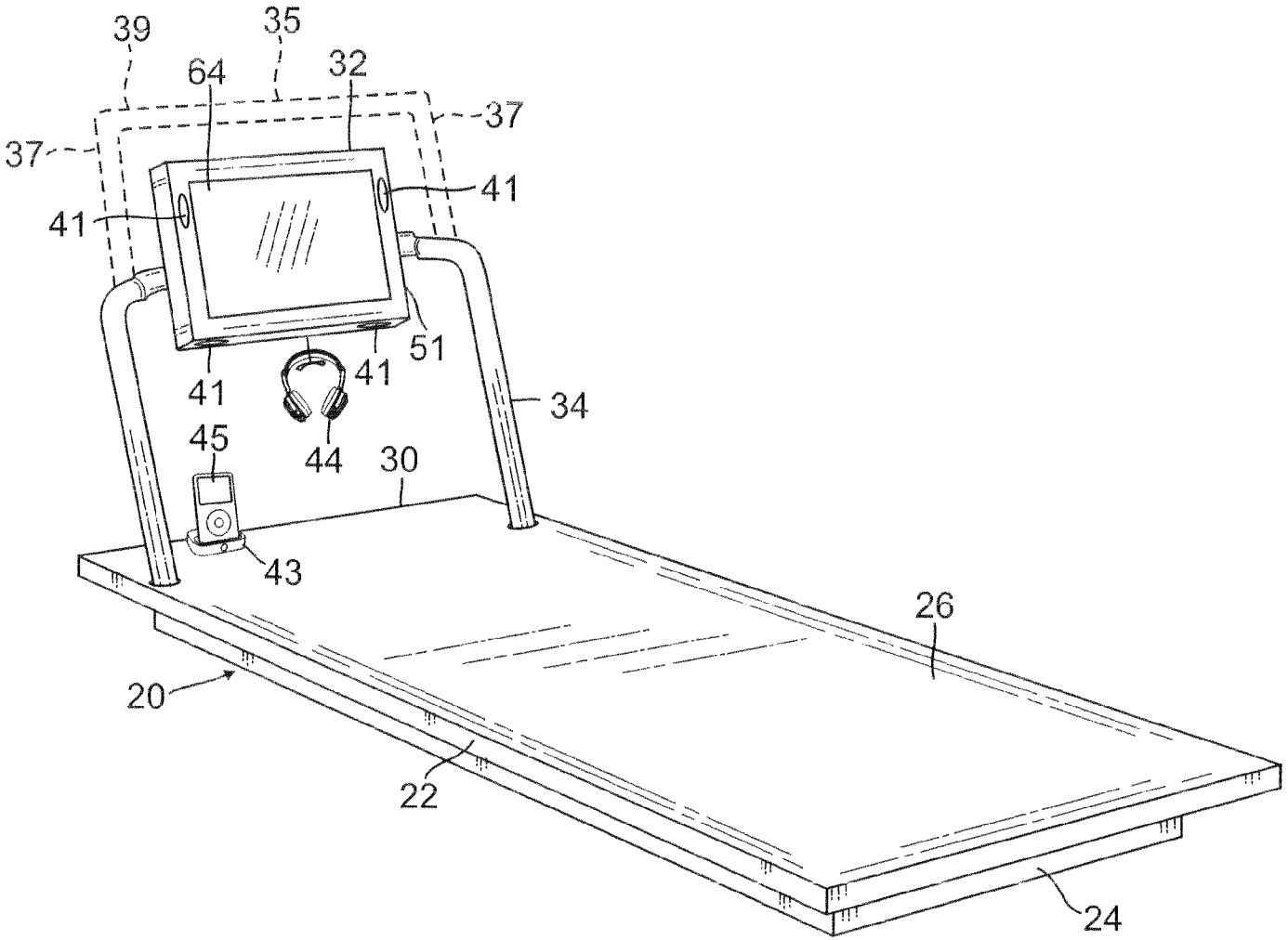
FIG. 1 is a front perspective view of one embodiment of the present exercise apparatus.

In the detailed description that follows, the present embodiments are described with reference to the drawings. In the drawings, elements of the present embodiments are labeled with reference numbers. These reference numbers are reproduced below in connection with the discussion of the corresponding drawing features.

Embodiments of the present exercise apparatus offer cost-effective, studio quality yoga, Pilates, body toning or stretching classes to people looking for choices in the length focus and ability level of their practice. In certain embodiments the apparatus is a self-contained exercise platform with an integrated touch screen and computer. The exercise apparatus allows a user to browse a catalog of pre-recorded instructional exercise videos and select one of interest to guide the user's workout. Classes are displayed on the display associated with the platform. Audio may be provided through one or more audio speakers. In certain embodiments the speakers may comprise headphones, which may be rechargeable and/or wireless. The audio may comprise verbal instructions, background music or sounds, or both. Choices of instructor, class length, class focus, and skill level may be offered. The user may select from the library of classes and follow along at his or her leisure and according to his or her own schedule.

The exercise apparatus serves gym members and home users that prefer not to participate in a group setting or do not otherwise have access to a yoga studio or group classes. The exercise apparatus provides private yoga, Pilates, body toning or stretching instruction with the push of a button. Rather than racing to the gym to secure a spot in a crowded pre-scheduled exercise class, users can take advantage of the present embodiments at their own convenience. The apparatus may be preloaded with software that enables the user to quickly and easily browse and select from a wide variety of workout programs. Once an episode is selected it plays on the video display, allowing the user to follow the session aid practice yoga, Pilates, body toning or stretching on his or her own.

Figure 2:
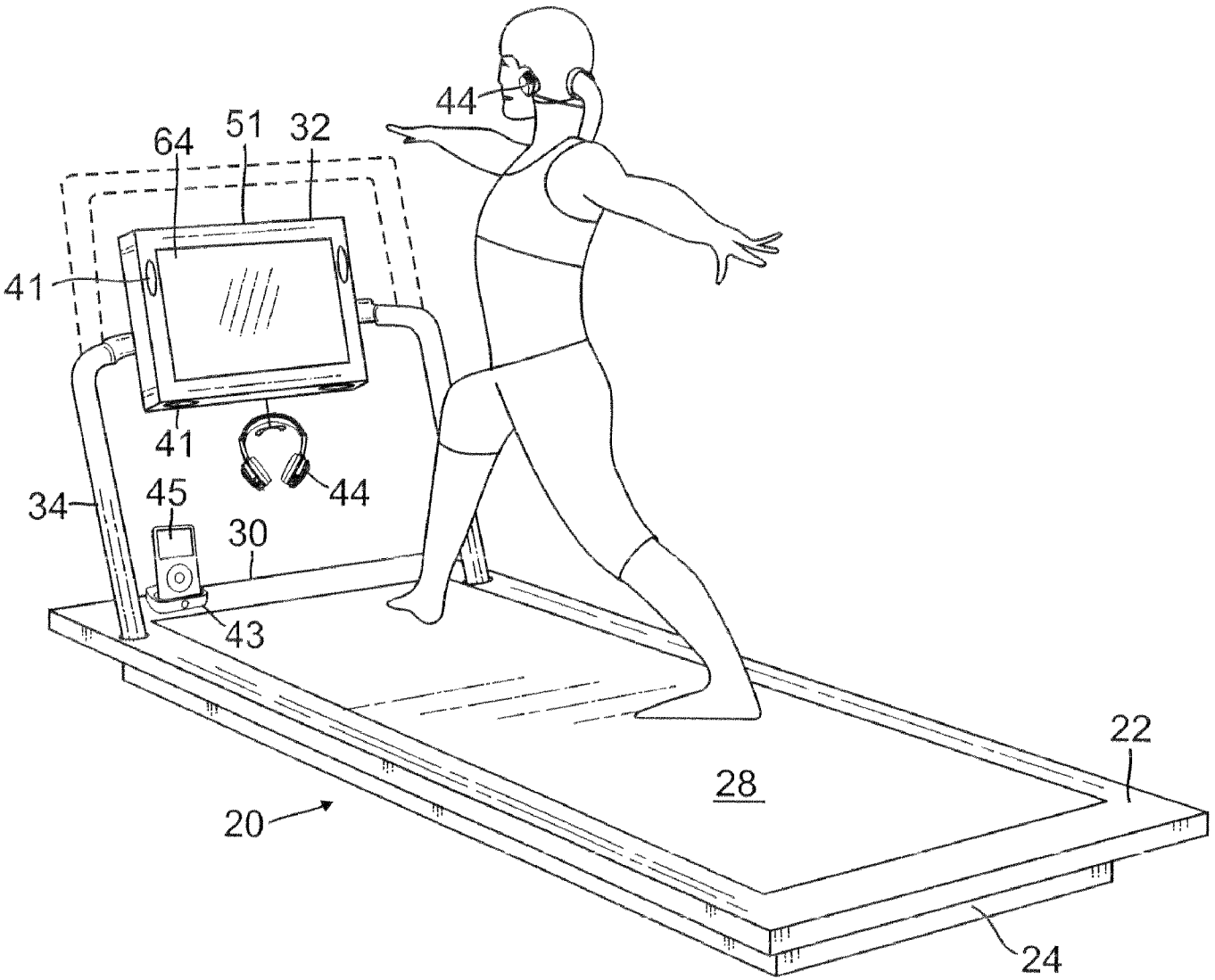
FIG. 2 is a front perspective view of the exercise apparatus of FIG. 1, including a user.

FIGS. 1 and 2 illustrate one embodiment of the present exercise apparatus 20. The exercise apparatus 20 is configured for a person performing yoga, Pilates, body toning or stretching exercises. However, those of ordinary skill in the art will appreciate that the present exercise apparatus 20 could be used by people performing other types of exercise, such as aerobics or tai chi. While the embodiments of the present exercise apparatus 20 are described herein with reference to yoga, Pilates, body toning or stretching exercises, the present embodiments are not limited to being used for only yoga Pilates, body toning or stretching exercises.

In the illustrated embodiment, the exercise apparatus 20 includes a platform 22 configured to support a person while performing exercises. In the illustrated embodiment, the platform 22 sits atop a short pedestal 24. The platform 22 and pedestal 24 may be constructed of one or more rigid materials such as wood, metal, durable plastics and/or composites. A lower surface of the pedestal 24 may be at least partially covered with a soft material (not shown), such as foam, to prevent the pedestal 24 from damaging wood floors. An upper surface 26 (FIG. 1) of the platform 22 may include texturing or grip tape (not shown) to receive an exercise mat 28 (FIG. 2) and prevent the mat 28 from slipping relative to the platform 22 during exercise.

Figure 3:
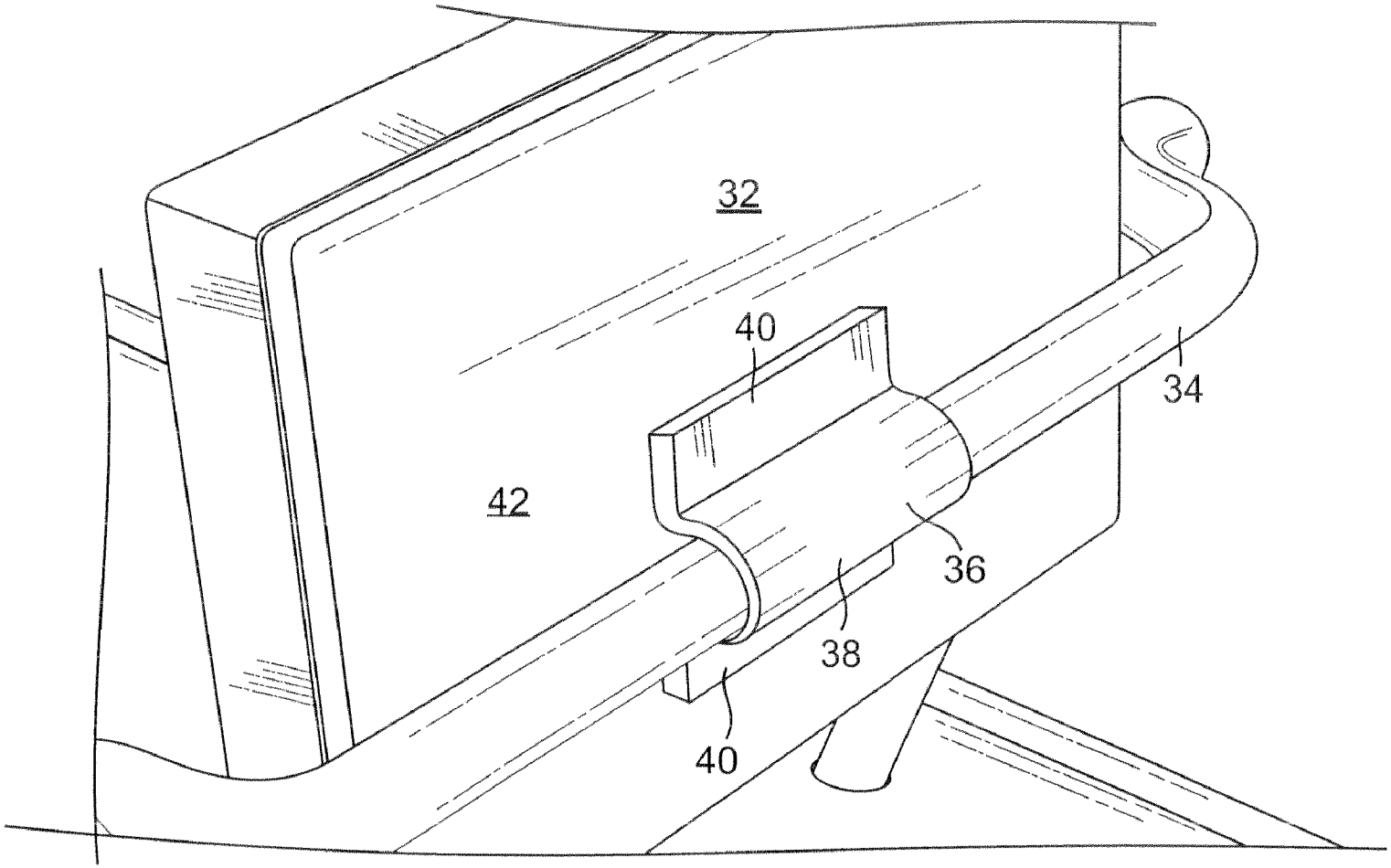
FIG. 3 is a rear perspective view of the video display of the exercise apparatus of FIG. 1.

A forward portion 30 of the exercise apparatus 20 includes a video display 32. The display 32 may be, for example, a high-definition display, such as LCD or plasma. The video display 32 is configured to provide the user with an instructional yoga. Pilates body toning or stretching routine. In the illustrated embodiment, the video display 32 is mounted to a railing 34 positioned at the forward portion 30 of the exercise apparatus 20. With reference to FIG. 3, which illustrates the video display 32 from a rear perspective, a bracket 36 may mount the video display 32 to the railing 34. In the illustrated embodiment, the bracket 36 includes a U-shaped portion 38 configured to extend around the railing 34 and first and second planar portions 40 configured to abut a rear face 42 of the display 32. The bracket 36 enables the video display 32 to tilt about a horizontal axis. The user can thus adjust the viewing angle of the video display 32 to provide a clear view of the video display 32. For example, a taller user may tilt the display 32 upward, while a shorter user may tilt the display 32 downward.

With reference to FIG. 1, in certain embodiments the railing 34 includes an extension portion 35 shaped substantially as an upside-down U. Uprights 37 of the extension portion 35 extend upward from opposite ends of the railing 34, and a crossbar 39 extends above the display 32 and connects the uprights 37. The extension portion 35 can be used for a variety of exercise purposes, such as for support during a stretching routine.

With continued reference to FIGS. 1 and 2, audio for the routine may be provided through one or more speakers 41 and/or through a wired or wireless transmission to headphones 44. In certain embodiments an interface between the headphones 44 and the exercise apparatus 20 may enable the headphones 44 to be recharged when they are docked with the exercise apparatus 20. For example, the interface may be magnetic to keep the headphones 44 secure with respect to the exercise apparatus 20.

Audio for the routine may comprise one or both of verbal instructions and background music or soothing sounds. Digital music files may be stored in a mass storage device 50 (FIG. 4) associated with the exercise apparatus 20. Thus, a user may select from a list of songs to play during exercise. Alternatively, or in addition, an input port 43 may be provided to receive audio inputs from a portable music player 45 such as an iPod®. The user can thus customize the audio portion of the exercise program with his or her own music. Separate volume controls (not shown) may be provided for instructional audio and music audio to allow the user to mix the sound according to his or her own preferences.

Embodiments of the present exercise apparatus 20 include software configured to assist the user in selecting a yoga, Pilates, body toning or stretching routine. An example of the software is described in detail below. Certain embodiments may further include a library 52 (FIG. 4) of yoga, Pilates body toning or stretching routines pre-installed in mass storage of the exercise apparatus 20, as explained in further detail below.

Figure 4:
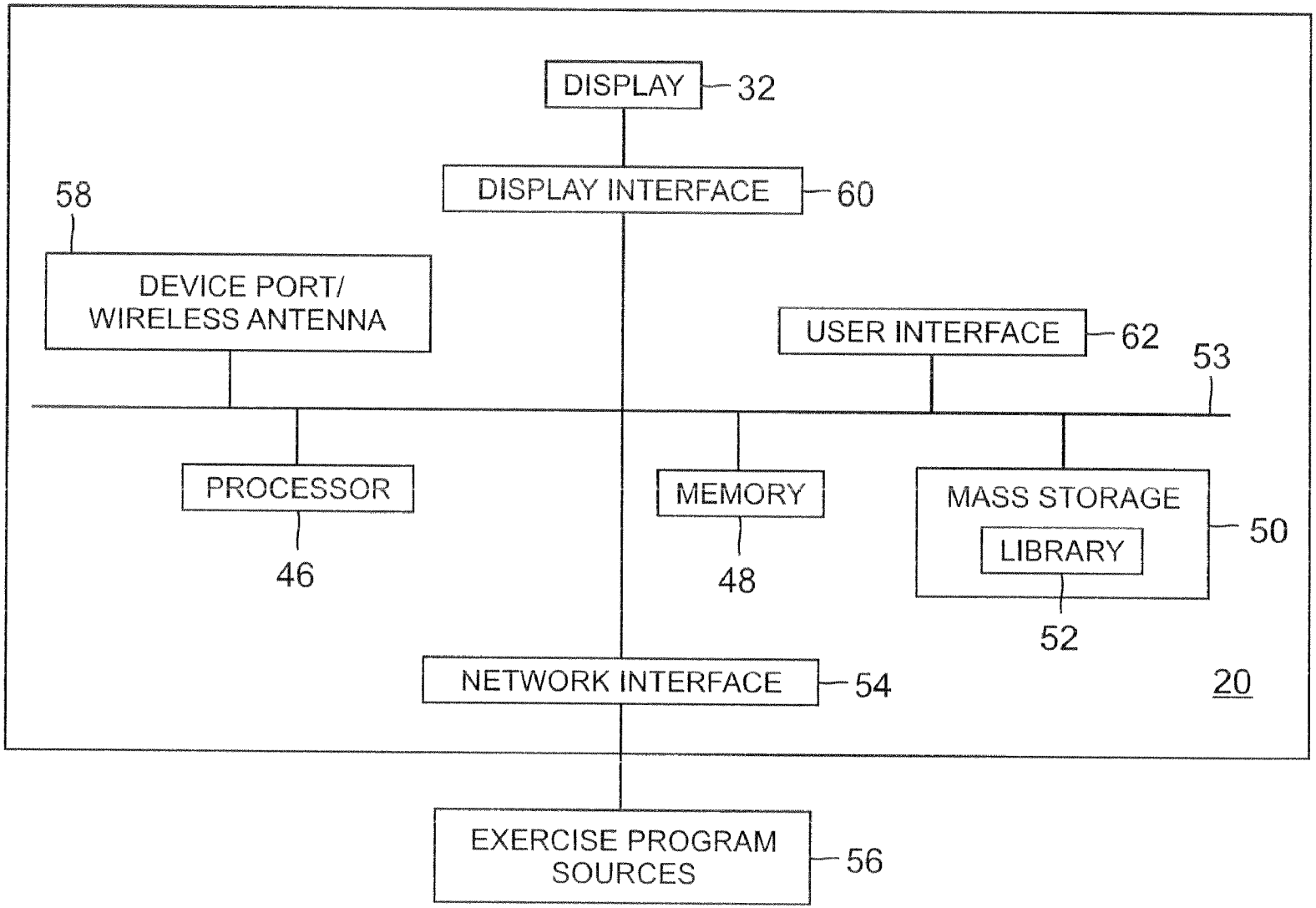
FIG. 4 is a functional block diagram of the exercise apparatus of FIG. 1.

FIG. 4 illustrates a functional block diagram of the exercise apparatus 20 of FIGS. 1-3. Some or all of the components shown in FIG. 4 may be enclosed within a housing 51 of the video display 32. The illustrated exercise apparatus 20 includes a processor 46 for executing executable code and responding to user commands. The processor 46 interfaces with a memory module 48, which stores the executable code. The exercise apparatus 20 further includes a mass storage device 50 that may store a database or library 52. The library 52 may include a plurality of exercise routines. The mass storage device 50 may be, for example, a hard disk, a flash device, an optical drive, etc. The mass storage device 50 may be erasable and rewritable so that the library 52 can be updated with new exercise routines and old routines may be erased as desired.

The illustrated exercise apparatus 20 further includes a network interface 54 configured to enable the exercise apparatus 20 to communicate with a network, such as the Internet. The network may include one or more sources 56 of additional exercise programs, including yoga, Pilates, body toning or stretching routines. The user may stream routines from the network and/or download and save them to the mass storage device 50 for later playback. Streaming and/or downloading may occur in real time.

In certain embodiments the exercise apparatus 20 may include a device port and/or wireless antenna 58. For convenience, the device port/wireless antenna 58 will be referred to hereinafter as a device port 58. The device port 58 enables the user to download routines from the exercise apparatus 20 and/or directly from the network to a portable electronic device (not shown), such as a personal data assistant (PDA) or an iPod®. The device port 58 also enables the user to upload routines to the exercise apparatus 20 from a portable electronic device. In certain embodiments the device port 58 may enable wireless downloading/uploading via BLUETOOTH®. In some embodiments the user may request to download a routine from the network, and retrieve the download at a later time through a link e-mailed to the user's personal e-mail account. The user can then retrieve the routine later by downloading it directly to his or her personal computer.

With continued reference to FIG. 4, the illustrated exercise apparatus 20 further includes a display 32 as described above. A display interface 60 enables the other components of the exercise apparatus 20 to communicate with the display 32. The illustrated exercise apparatus 20 further includes a user interface 62 that enables the user to issue commands to the exercise apparatus 20. The user interface 62 may comprise a keyboard (not shown) and/or a pointing device (not shown), such as a mouse or a trackball. In another embodiment, the user interface 62 may be integrated into the video display 32 in the form of a touch screen 64 (FIGS. 1 and 2). The user may respond to prompts on the screen 64 by touching designated areas of the screen 64. The user may also enter information as needed such as for downloading exercise routines and signing tip for newsletters or other information. The touch screen 64 may include a pop-up touch screen keyboard (not shown) to facilitate the user's ability to enter information.

FIGS. 5-10 illustrate example screen shots that the user may see on the display 32 of the present exercise apparatus 20. For simplicity, the process flow for navigating the illustrated screens will be described hereinafter with reference to the touch screen 64. Those of ordinary skill in the art will appreciate, however, that any variety of input devices could be used instead of a touch screen to interact with the present exercise apparatus 20. Further, those of ordinary skill in the art will appreciate that details of the illustrated screen shots such as graphics and layout are not meant to be limiting.

Figure 5:
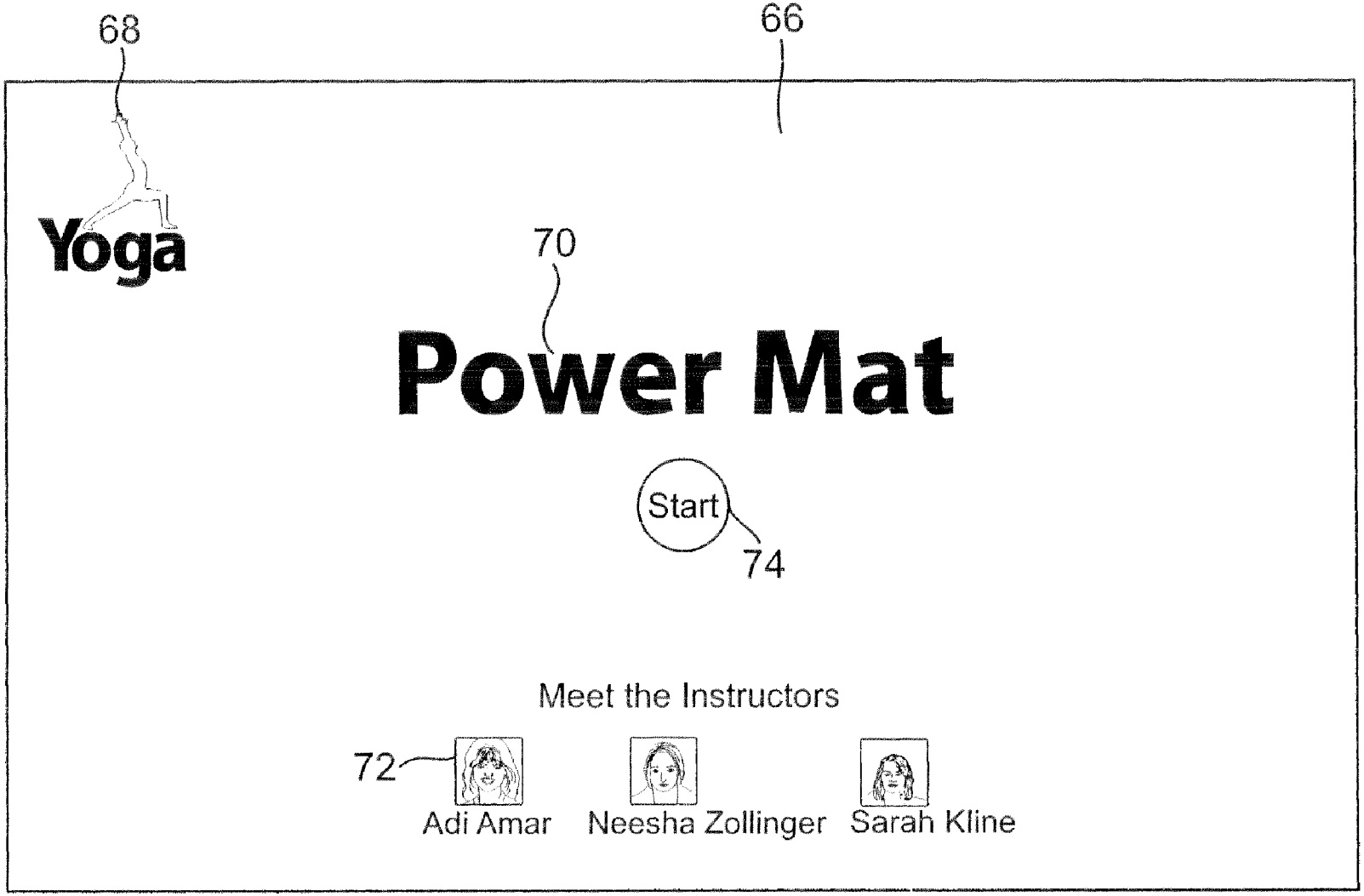
FIG. 5 is a screen shot of a main menu of the exercise apparatus of FIG. 1.

FIG. 5 illustrates a welcome screen 66. In the illustrated embodiment, the welcome screen 66 includes a logo 68 identifying the producer of the exercise apparatus 20, and a product name 70 identifying the exercise apparatus 20 itself. In certain embodiments, the welcome screen 66 may also identify some or all of the instructors 72 of the exercise routines. As shown the instructors may be identified by name and/or likeness. The welcome screen 66 further includes a "Start" button 74.

Figure 6A:
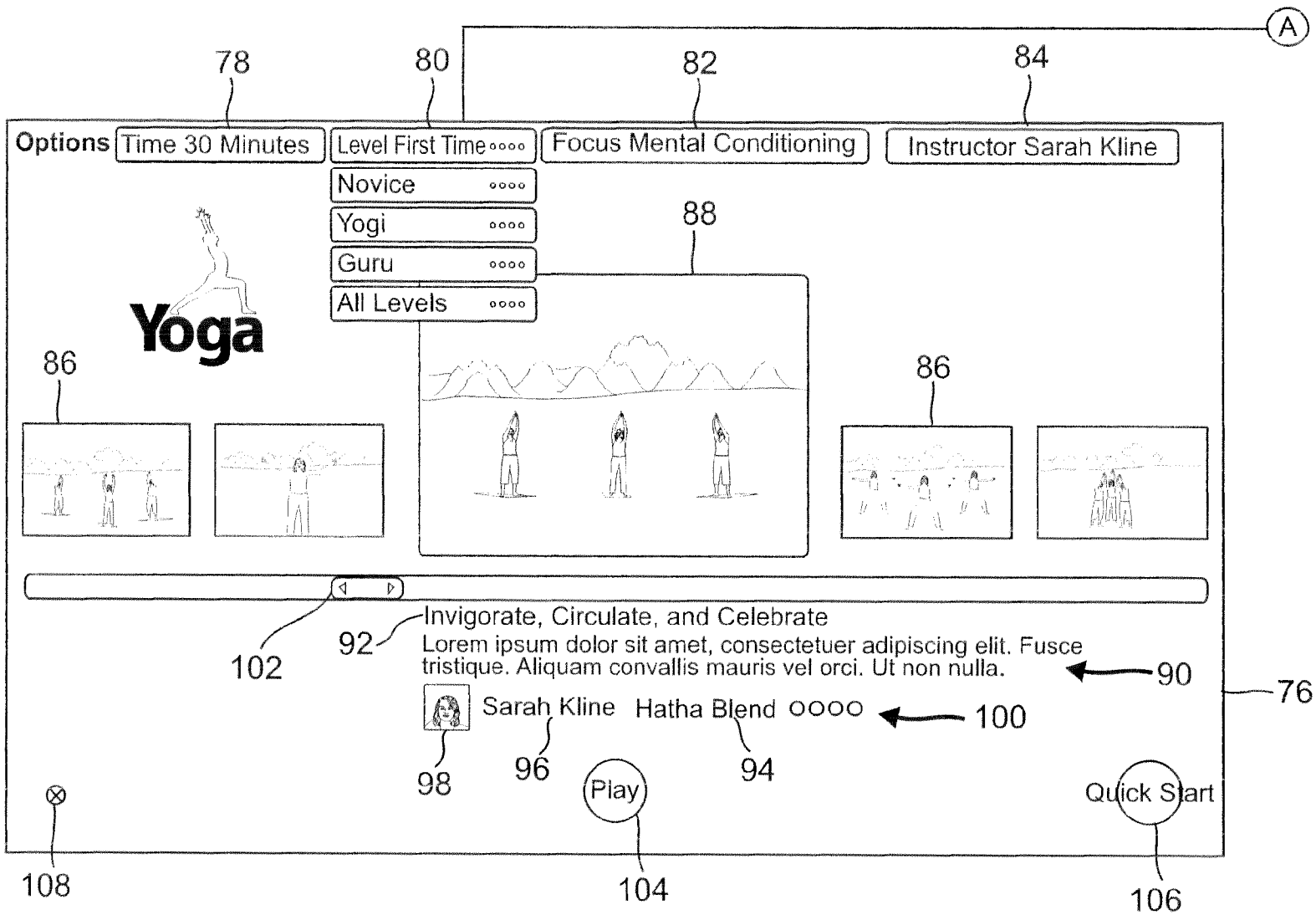
FIG. 6 is a screen shot of a course selection screen of the exercise apparatus of FIG. 1.
Figures 6, 6B:
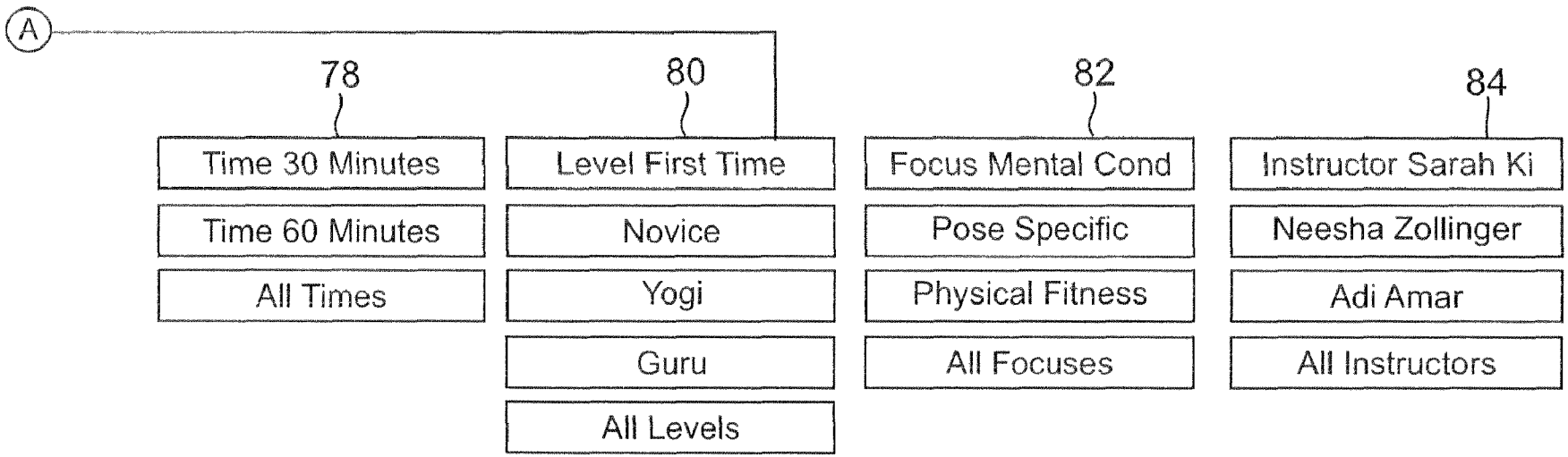

When the user presses the "Start" button 74, executable code transitions the welcome screen 66 to a routine selection screen 76, illustrated in FIG. 6. On the routine selection screen 76 a plurality of dropdown menus 78, 80, 82, 84 are provided along the upper edge. The dropdown menus 78, 80, 82, 84 enable the user to narrow down the various routines stored in the mass storage device 50 by specifying certain criteria. In the illustrated embodiment, the dropdown menus include duration 78, skill level 80, focus 82 and instructor 84. For example, the duration menu 78 allows the user to choose from two available durations (30 minutes or 60 minutes) for his or her routine. Similarly, the skill level menu 80 provides a choice between different skill levels: first time, novice, yogi and guru, for example. Each of the menus 78, 80, 82, 84 further provides an option to forgo narrowing the routines based on that criteria by selecting "All Times," "All Levels," etc. In certain embodiments, each of the dropdown menus 78, 80, 82, 84 may be set to "All" by default, so that the user can begin with the widest selection of routines and narrow the choices down from there. Those of ordinary skill in the art will appreciate that the illustrated embodiment is merely one example. In other embodiments fewer or more dropdown menus may be provided, and each dropdown menu may include fewer or more options. For example, the duration menu 78 may provide options of 15 minutes, 45 minutes, etc.

The routine selection screen 76 further includes a plurality of thumbnails (small pictures) or thumbnail movies (small videos) 86, 88 representing each of the classes that fit the criteria selected by the user. As the user adds, modifies and deletes criteria using the dropdown menus 78, 80, 82, 84, thumbnails 86, 88 appear and disappear from the screen. In the illustrated embodiment, the thumbnails 86, 88 are arranged side-by-side horizontally across the screen. The thumbnail video 88 that is positioned in the side-by-side center of the screen is displayed at a larger size, and may appear in sharper focus than the peripheral thumbnail videos 86. A brief description 90 of the center routine is displayed below the center thumbnail video 88. The description may include a title 92, the routine's focus 94, the identity of the instructor 96 and his or her likeness 98, and/or the skill level 100. In certain embodiments, a link may be provided within the description 90 to the instructor's biography. For example, tapping the instructor's likeness 98 and/or name 96 may link to the instructor's biography. The instructors' biography may describe his or her background and skills. Additional links (not shown) may also be provided to screens that expand the class description to offer greater detail or more information about the episode.

A scroll bar 102 enables the user to move from one thumbnail or thumbnail video 86, 88 to the next by dragging the scroll bar 102 left and right. To begin playing the routine whose thumbnail video 88 is positioned in the center of the screen, the user taps the "Play" button 104 located at the bottom center of the screen 76. Alternatively, the user may tap a "Quick Start" button 106 located in the lower right of the screen 76 in order to have the system randomly select one of the routines that fit any of the user-selected criteria or from the entire archive if the user has not selected any criteria. Those of ordinary skill in the art will appreciate that certain embodiments may not include the "Quick Start" feature. If the user desires to return to the welcome screen 66 of FIG. 5, he or she may tap the "Cancel" button 108 located in the lower left of the screen 76.

In certain embodiments, the touch screen interface 64 may enable the user to move from one thumbnail 86, 88 to the next by simply dragging his or her finger across the touch screen 64 to the left and right. This feature may be in addition to, or instead of, the scroll bar 102. Further, in certain embodiments the touch screen interface 64 may enable the user to jump directly to one of the peripheral thumbnails 86 by tapping it. The tapped thumbnail 86 would then appear immediately in the center of the screen, and a description of that routine would appear below the thumbnail 88.

In certain embodiments the present exercise apparatus 20 may enable the user to perform keyword searches by selecting a search button (not shown) on the routine selection screen 76. Selecting the search button may launch a touch keyboard (not shown) enabling the user to input search terms. The processor 46 then searches through the contents of the library 52 looking for exercise routines that match the search terms. Results are shown on the routine selection screen 76 and the user may select any of the results or perform a new search.

Figure 7:
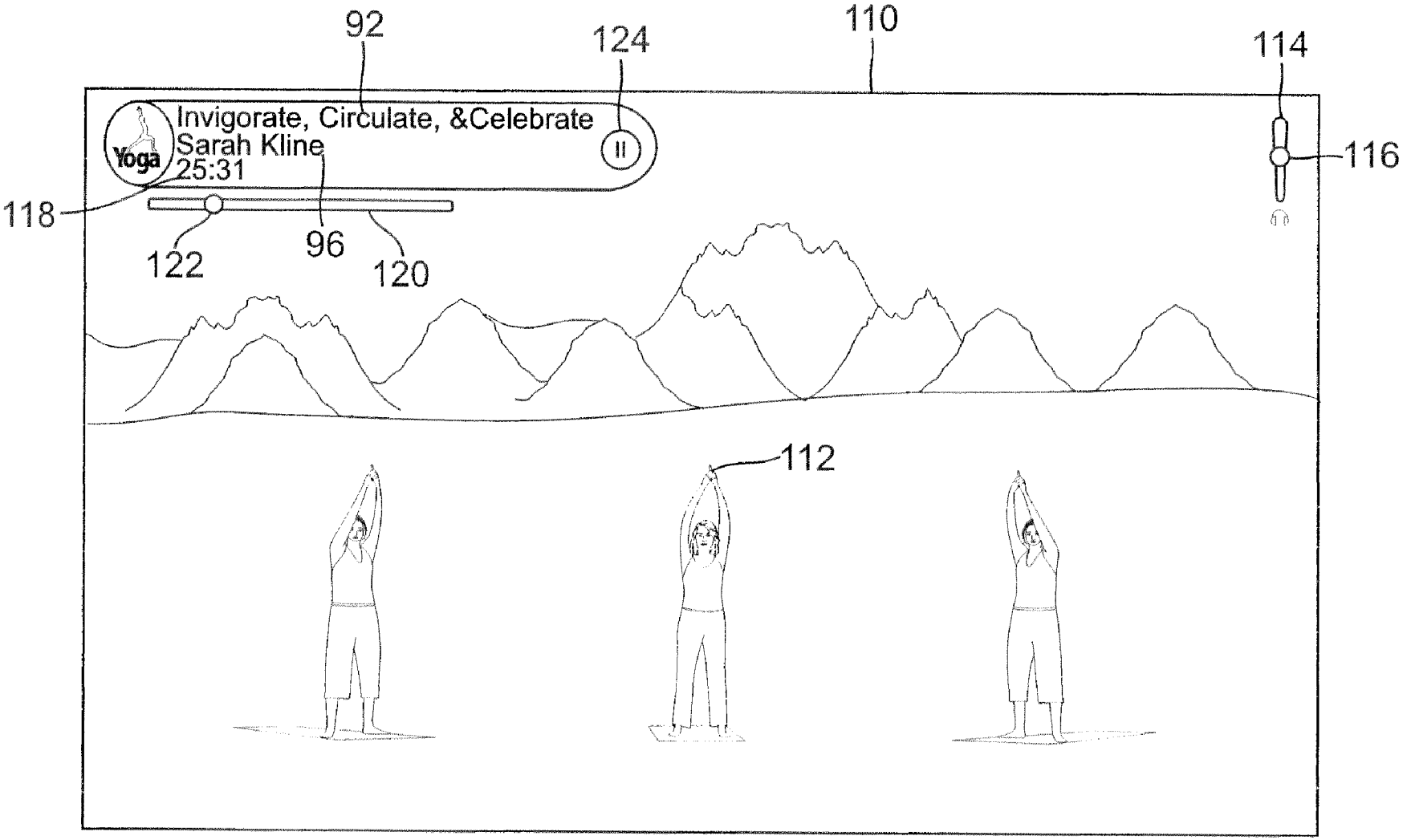
FIG. 7 is a screen shot of a play screen of the exercise apparatus of FIG. 1.
Figure 8:
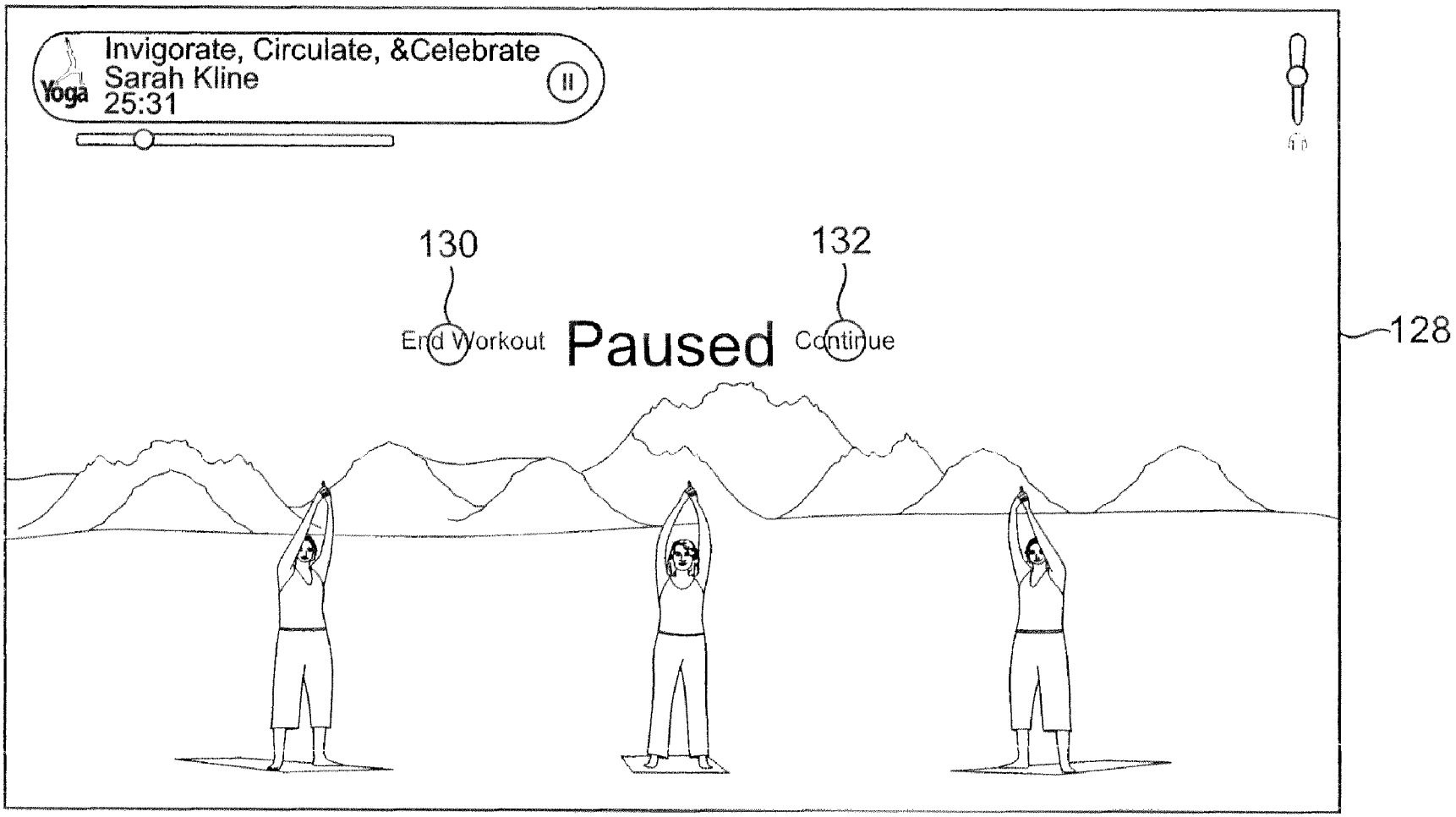
FIG. 8 is a screen shot of a pause screen of the exercise apparatus of FIG. 1.
Figure 9:
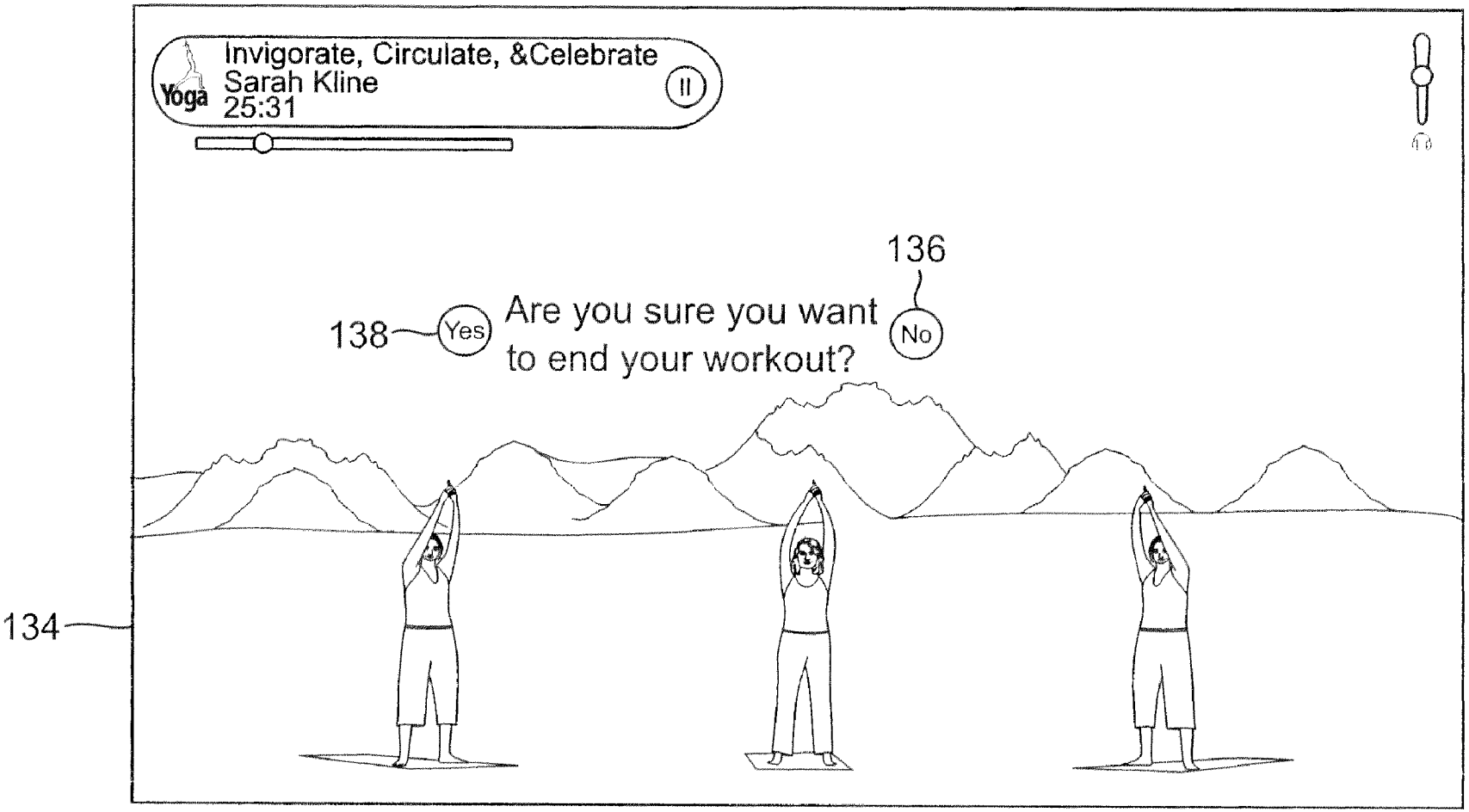
FIG. 9 is a screen shot of a confirm quit screen of the exercise apparatus of FIG. 1.
Figure 10:
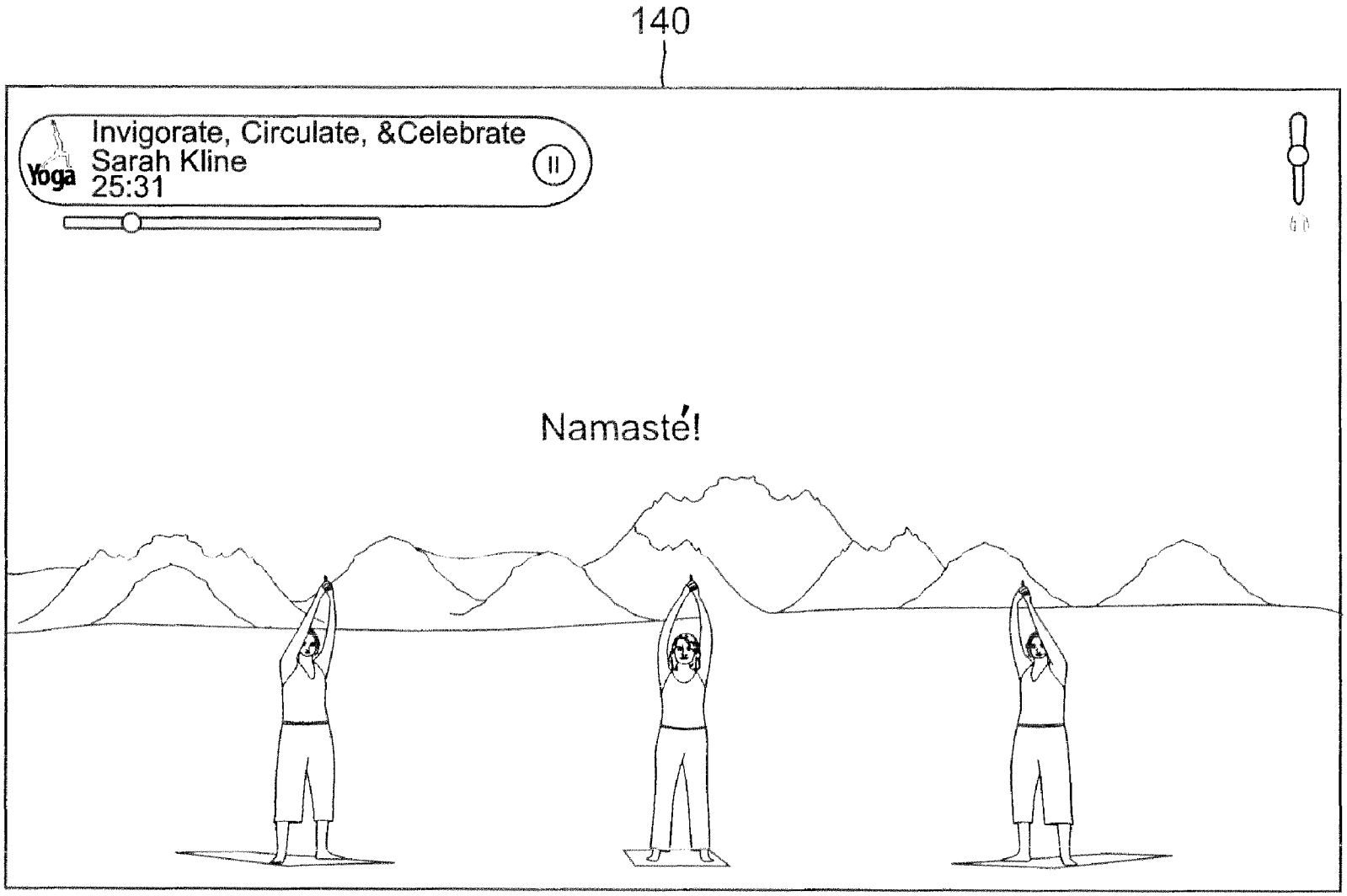
FIG. 10 is a screen shot of a farewell screen of the exercise apparatus of FIG. 1.

When the user begins a routine, the routine selection screen 76 transitions to the play screen 110 shown in FIG. 7. The routine commences, and the instructor 112 guides the user through the routine by demonstrating motions, poses, etc. The routine also includes an audio component, which may comprise verbal instructions and/or encouragement provided by the instructor. The audio may also include music designed to relax and/or motivate the user. Instead of, or in addition to, the music, the audio may include soothing nature sounds, such as chirping birds, crashing waves, etc. A volume meter 114 in the upper right-hand corner of the screen 110 indicates the volume produced by the exercise apparatus 20. By dragging an indicator 116 up or down the meter 114, the user can adjust the volume up or down. In some embodiments, separate volume controls (not shown) may be provided for verbal instruction and accompanying music or nature sounds to give the user control over the background audio. Additionally, in some embodiments the user may be able to select from several audio options such as a default music playlist, default nature sounds, a specified playlist from the user's portable digital music player, and no audio.

In the illustrated embodiment, the play screen 110 further includes information regarding the routine in the upper left-hand corner. The information may include details such as the routine title 92 and the instructor's name 96. The play screen 110 may also include a digital timer 118 and/or a timer bar 120. The timer 118 may count up or down to indicate to the user how much time has elapsed since the routine began or to indicate how much time is left in the routine. In certain embodiments, the user may specify whether the timer is displayed or not. The timer bar 120 may include an indicator 122 that moves from left to right across the bar 120 as time elapses, reaching the far right of the bar 120 as the routine ends. In certain embodiments, the timer bar 120 may also serve as a video controller, allowing the user to fast-forward or rewind the video according to his or her preferences.

In the illustrated embodiment, the play screen 110 further includes a pause button 124. When the user taps the pause button 174 the play screen 110 transitions to the pause screen 128 shown in FIG. 8. On this screen the routine pauses and the display 32 may darken slightly and/or go out of focus. "Paused" appears on the screen along with two buttons. Tapping the first button 130, "End Workout," enables the user to end the routine and return to the welcome screen 66 of FIG. 5. Tapping the second button 132, "Continue," resumes the routine. If the user selects "End Workout," 130 the pause screen 128 may transition to a confirmation screen 134, shown in FIG. 9. On this screen the user is asked to confirm whether or not he or she desires to end the routine. Selecting "No" 136 returns the user to the pause screen 128 shown in FIG. 8. Selecting "Yes" 138 transitions the pause screen 128 to a farewell screen 140, shown in FIG. 10. On this screen a farewell is briefly shown, after which the display 32 transitions back to the welcome screen 66 of FIG. 5.

If the user does not actively end the exercise routine, it will conclude on its own at the end of the specified routine duration. At the conclusion of the routine, in certain embodiments a Shavasana sequence (not shown) may automatically begin. The Shavasana sequence may feature relaxing images on the display 32, such as clouds, water, mountains, and animals, and may be accompanied by mellow music or other mellowing audio. The Shavasana sequence continues for a set duration, such as for five minutes, after which the system resets and returns to the welcome screen 66 of FIG. 5. The Shavasana sequence may be stored in a location independent of each routine thus conserving memory space.

In certain embodiments, the exercise apparatus may enable the user to tag various portions of an exercise program to link to a sub-program. For example, if the instructor on the video display is demonstrating a yoga pose such as Hanumasana, a link may appear on the video display. When the user selects the link, the program may pause and present another screen that provides an explanation of that particular pose. An additional link may then be provided to a short video providing a more detailed explanation and demonstration of the pose. This feature substitutes for personalized instruction and demonstration that would be provided by a live instructor in classroom setting. In another embodiment, if the instructor on the video display is demonstrating a specific prop, a link may be provided on the display that would pause the video and take the user to a point of purchase for that particular item.

Figure 11:
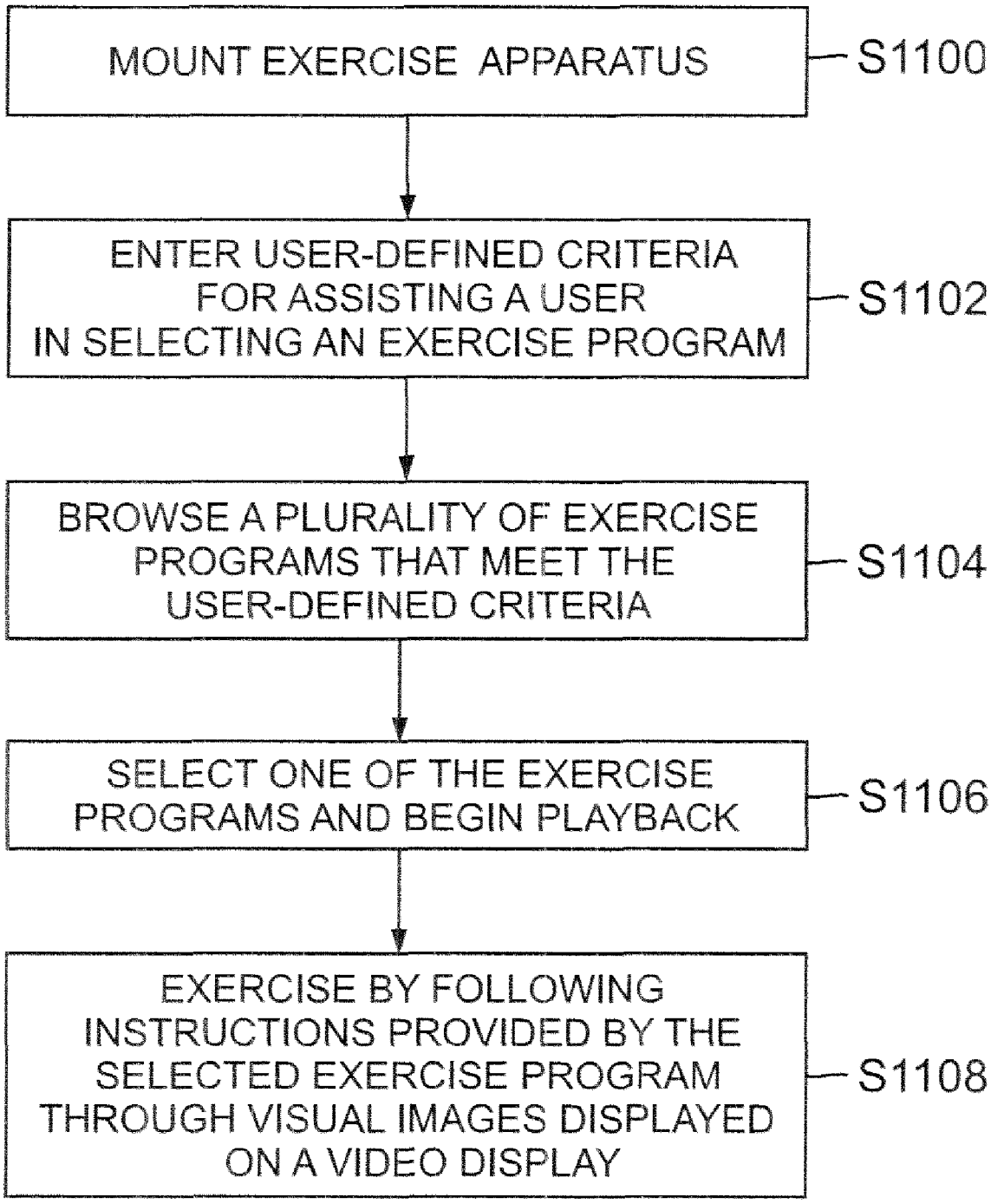
FIG. 11 is a process flowchart illustrating one embodiment of a process for selecting an exercise routine using the present exercise apparatus.

FIG. 11 is a process flowchart illustrating a method of exercising using the present exercise apparatus. The process begins at step S1100 when the user mounts a platform of the exercise apparatus. In some embodiments, however, step S1100 may be performed after at least one of the steps described below. At step S1102 the user enters user-defined criteria via a user interface for assisting the user in selecting an exercise program. The user-defined criteria may include at least one of program duration, program skill level, program focus, program setting, and instructor. The user may enter the criteria with the aid of a video display and a user interface. At step S1104 the user browses a plurality of exercise programs that meet the user-defined criteria. At step S1106 the user selects one of the exercise programs and plays back the selected exercise program. At step S1108 the user exercises by following instructions provided by the selected exercise program through visual images displayed on the video display.

The embodiments of the present exercise apparatus and methods provide an interactive, fully-guided training system. The system enables anyone to reap the benefits of professionally-taught classes, without the crowds, cost or hassle of going to a specialized studio. The user determines what type of exercise to perform, for example yoga, Pilates core, and/or stretching exercises. The user may then select an instructor personality and/or a class theme to suit his or her needs. Advantageously, the user may choose the time, level and pace.

Figure 12:
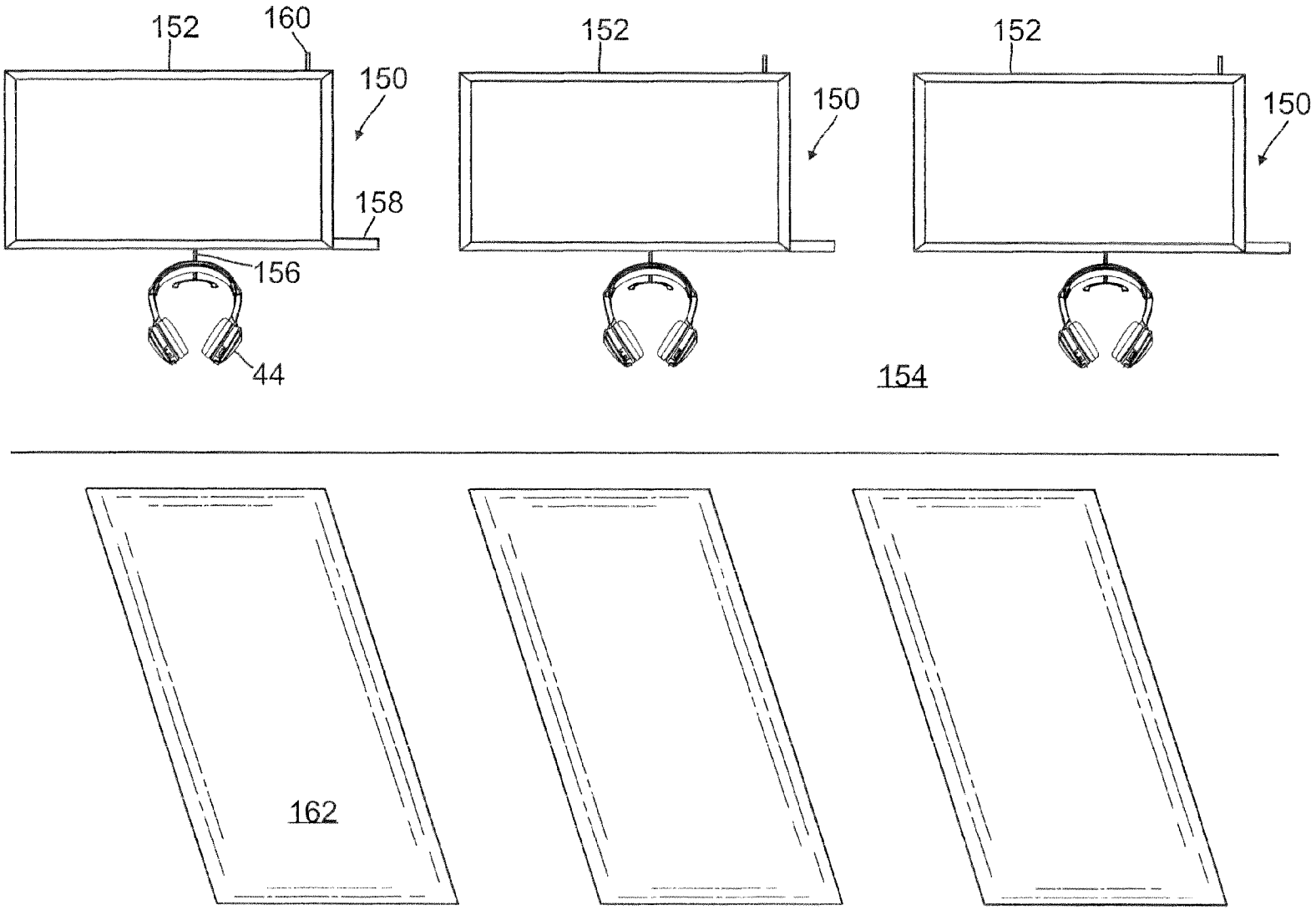
FIG. 12 is a front perspective view of another embodiment of the present exercise apparatus.
Figure 13:
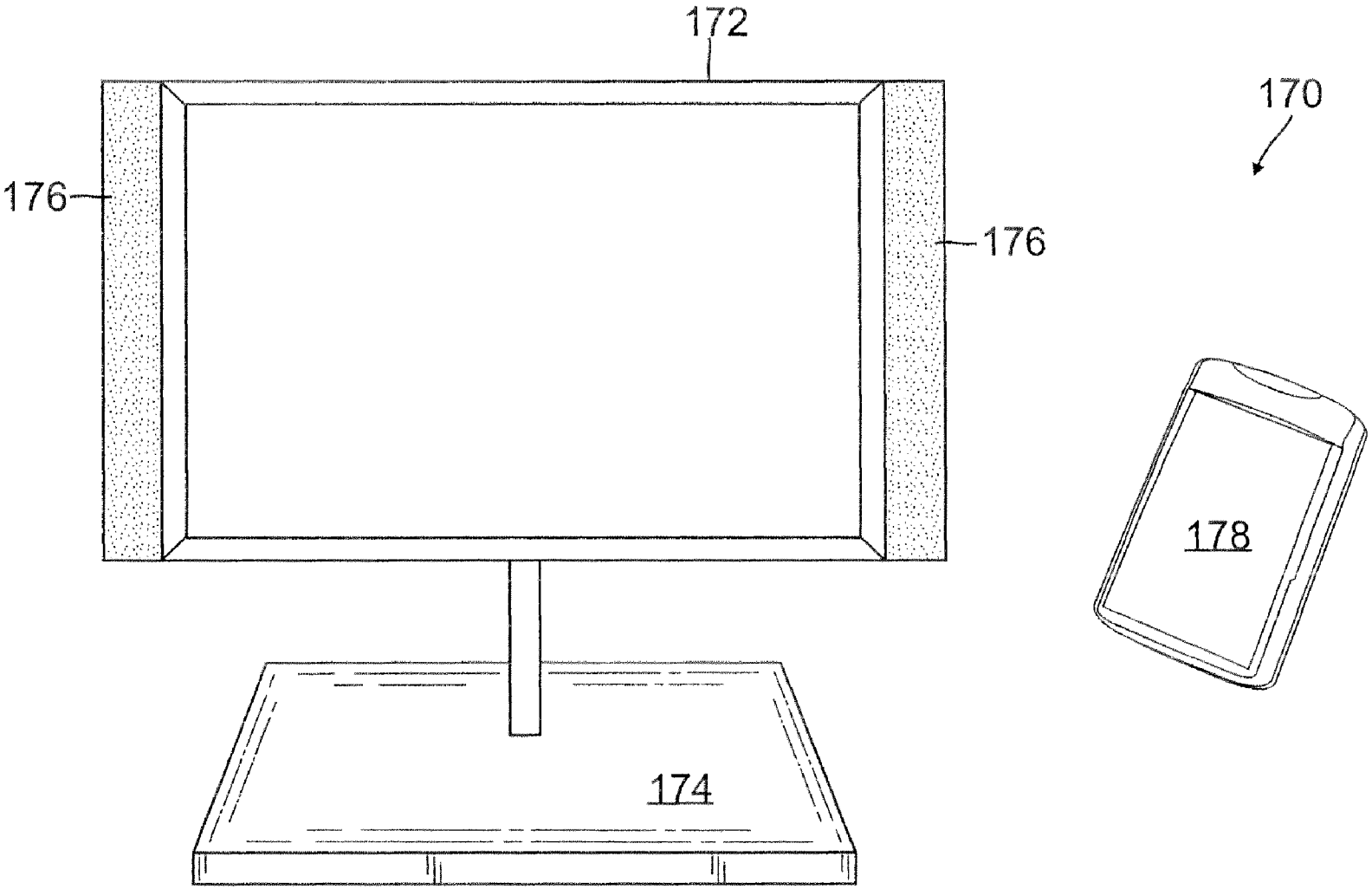
FIG. 13 is a front perspective view of another embodiment of the present exercise apparatus.

FIGS. 12 and 13 illustrate alternative embodiments of the present exercise apparatus. FIG. 12 illustrates several apparatus 150 positioned in proximity to one another, such as one might find in a commercial gym. The apparatus 150 include all of the components of the embodiments described above, except that the video display 152 is mounted on a wall 154 rather than being integrated with a platform and railing. A user positions himself or herself in front of one of the apparatus and interacts with the display 152 and audio in the same manner as described above. For examples, the video display 152 may include an integral headphone dock 156, portable music player dock 158 and wireless antenna 160. The user may position a cushioning mat 162 on the floor in front of the video display 152 for comfort. The video display 152 may tilt with respect to the wall 154 or otherwise enable the user to manipulate its position/orientation for a better view. In embodiments such as shown in FIG. 12, where several apparatus 150 are positioned in proximity to one another, multiple users may be able to participate to the same program, perhaps playing on the same video display 152, simultaneously. Audio for the program could be provided simultaneously to multiple headphones 44 or simply broadcast out of speakers on the video display 152. Similarly for group settings such as commercial gyms disposable covers and or alcohol wipes may be provided for the headphones 44 to maintain them in a sanitary condition.

The apparatus 170 of FIG. 13 similarly includes all of the components of the embodiments described above, except that the video display 172 is mounted on a stand 174 rather than a railing or a wall. The display 172 includes speakers 176 for program audio, and a remote control 178 to enable a user to interact with the display 172 from a distance.

SCOPE OF THE DISCLOSURE

The above description presents the best mode contemplated for carrying out the present exercise apparatus and methods, and of the manner and process of making and using it, in such full, clear, concise, and exact terms as to enable any person skilled in the art to which it pertains to make and use this exercise apparatus. This exercise apparatus is, however, susceptible to modifications and alternate constructions from that discussed above that are fully equivalent. Consequently, this exercise apparatus is not limited to the particular embodiments disclosed. On the contrary, this exercise apparatus covers all modifications and alternate constructions coming within the spirit and scope of the exercise apparatus as generally expressed by the following claims, which particularly point out and distinctly claim the subject matter of the exercise apparatus.

What is claimed is:

1. Exercise apparatus, comprising:

a platform configured to support a user while exercising;

a mass storage module including a plurality of instructional exercise programs, at least some of the instructional exercise programs being linked to sub-programs, wherein the sub-programs provide explanation or demonstration of one or more aspects of exercise, and the sub-programs are configured to be executed in response to user input;

a user interface configured to enable the user to select one of the exercise programs for playback; and a video display configured to show visual images corresponding to the selected exercise program as the program is played back.

2. The exercise apparatus of claim 1, further comprising a processor and a memory module.

3. The exercise apparatus of claim 1, further comprising a network interface for accessing additional instructional exercise programs stored on a computer network.

4. The exercise apparatus of claim 1, wherein the selected exercise program comprises a yoga routine, a Pilates routine, a body toning routine, or a stretching routine and the video display shows video images of an instructor as the program is played back.

5. The exercise apparatus of claim 1, wherein the user interface is a touch screen integrated with the video display.

6. The exercise apparatus of claim 1, further comprising audio speakers configured to provide audio corresponding to the selected exercise program.

7. The exercise apparatus of claim 6, wherein the audio speakers comprise headphones configured to be worn by the user.

8. The exercise apparatus of claim 7, wherein the headphones are wireless.

9. The exercise apparatus of claim 1, wherein at least some of the instructional exercise programs are linked to additional sub-programs, wherein each additional sub-program provides a point of purchase for an item that is shown on the video display in the instructional exercise program associated with the additional sub-program.

10. A method of exercising, the method comprising:

mounting a platform of an exercise apparatus;

entering, with the aid of a video display and a user interface, user-defined criteria for assisting a user in selecting an exercise program, the user-defined criteria including at least one of program duration, program skill level, program focus, program setting, and instructor;

browsing a plurality of exercise programs that meet the user-defined criteria;

selecting one of the exercise programs and playing back the selected exercise program; and exercising by following instructions provided by the selected exercise program through visual images displayed on the video display and corresponding audio instructions delivered via audio speakers.

11. The method of claim 10, wherein the selected exercise program comprises a yoga routine, a Pilates routine, a body toning routine or a stretching routine.

12. The method of claim 10, wherein browsing the plurality of exercise programs comprises viewing a description of the content of each program in the plurality of exercise programs.

13. The method of claim 10, further comprising pausing, fast-forwarding or rewinding the selected exercise program during playback.

14. The method of claim 10, wherein the user interface is a touch screen integrated into the video display.

15. The method of claim 10, further comprising providing audio corresponding to the selected exercise program.

16. The method of claim 15, wherein the audio is provided through headphones worn by the user.

17. The exercise apparatus of claim 16, wherein the headphones are wireless.

18. The method of claim 10, further comprising downloading an exercise program to the exercise apparatus from a computer network.

19. The method of claim 10, wherein while entering the user-defined criteria small pictures or small videos associated with each of the exercise programs are displayed on the video display, the displayed small pictures or small videos representing the exercise programs that meet the entered user-defined criteria.

20. The method of claim 19, wherein as the user-defined criteria are entered, modified or deleted, the small pictures or small videos appear and disappear from the video display.

21. The method of claim 19, further comprising displaying additional information regarding a selected one of the exercise programs in response to a user selecting one of the small pictures or small videos.

* * * * *